United States Patent [19]

Jeavons

[11] 4,130,308

[45] Dec. 19, 1978

[54] MOTOR VEHICLE DOOR LATCHES

[75] Inventor: Philip S. Jeavons, Birmingham, England

[73] Assignee: Wilmot-Breeden Limited, Birmingham, England

[21] Appl. No.: 825,078

[22] Filed: Aug. 16, 1977

[51] Int. Cl.[2] ..... E05C 3/26

[52] U.S. Cl. ..... 292/216; 292/341.12

[58] Field of Search ..... 292/341.12, 341.13, 292/DIG. 38, DIG. 72, 216

[56] References Cited

U.S. PATENT DOCUMENTS

| | | | |
|---|---|---|---|
| 3,848,911 | 11/1974 | Watermann et al. | 292/341.12 |
| 3,876,238 | 4/1975 | Watermann | 292/216 |

*Primary Examiner*—Richard E. Moore

*Attorney, Agent, or Firm*—Young & Thompson

[57] ABSTRACT

A latch for the door of a motor vehicle has a housing consisting of front and back plates between which a plastics moulding is disposed. Two pivot pins extend between the front and back plates with a U-shaped bolt mounted on one pivot pin and a cooperating pawl mounted on the other pivot pin. The plastics moulding includes portions which cooperate with a striker to guide it into engagement with the bolt and to provide a wedging action during the final stages of relative movement between the striker and the bolt. The portion of the moulding which provides the wedging action houses an elastomeric block that serves:

(a) as a noise-suppressant, (b) as a throw-out member, and (c) as a biassing element urging the bolt towards the adjacent surface of the housing.

7 Claims, 5 Drawing Figures

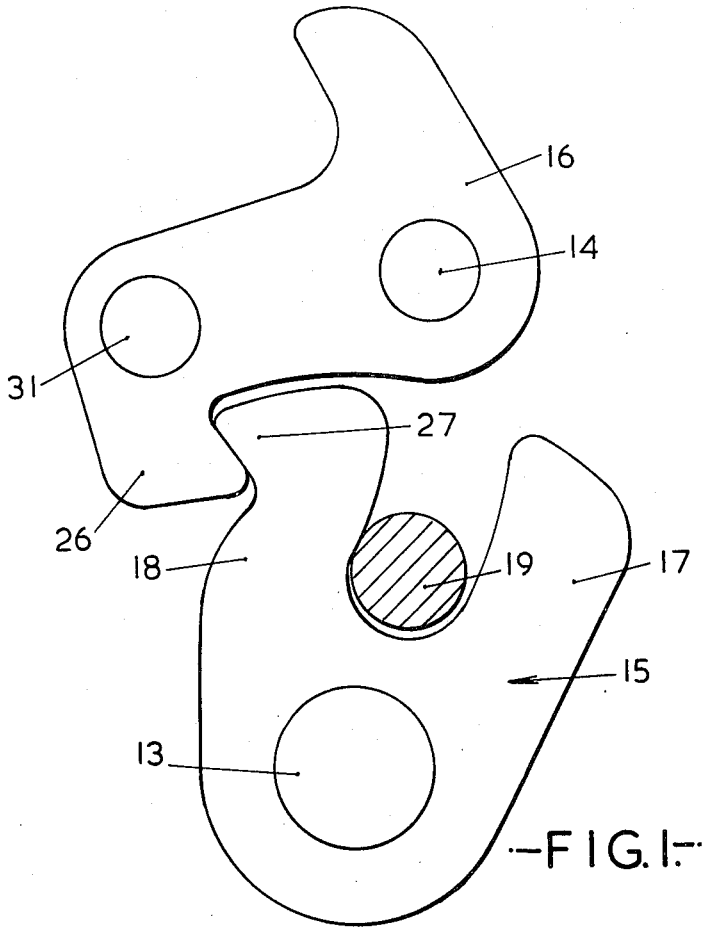
-FIG. 1-
-FIG. 3-
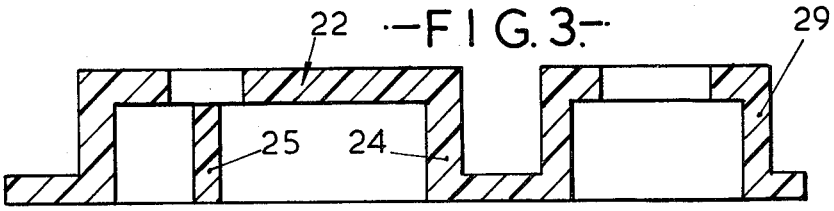
-FIG. 5-
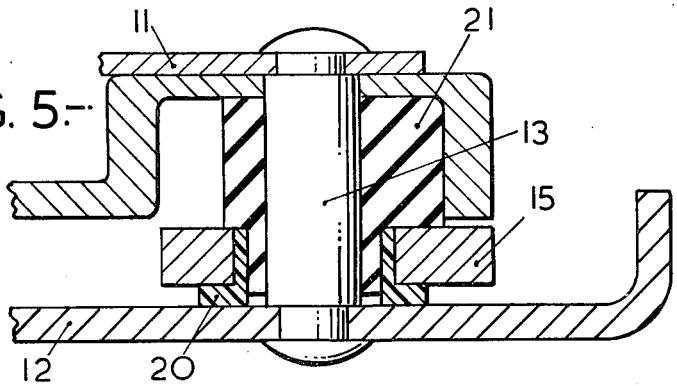

MOTOR VEHICLE DOOR LATCHES

This invention relates to latches for the doors of motor vehicles and has for its object the provision of an improved form of mounting for the bolt of such a latch.

According to the invention there is provided a latch for the door of a motor vehicle comprising a housing which includes front and back plates between which a plastics moulding is located, a generally U-shaped bolt mounted on a first pivot pin extending between the two plates, a pawl arranged to cooperate with the bolt to hold it in its locking position when engaged with a keeper, said pawl being mounted on a second pivot pin extending between the two plates, the plastics moulding including portions which are arranged to cooperate with the striker to guide it into engagement with the bolt and to obtain a wedging action during the final stages of relative movement between the striker and the bolt, the portion of the moulding which provides said wedging action housing an elastomeric block formed with an aperture through which said first pivot pin passes.

The means for mounting the bolt on the first pivot pin conveniently comprises a flanged plastics bush which is fitted in an aperture in the bolt, the flange of the bush being disposed in engagement with an adjacement surface of the housing whereby it acts as a spacer to prevent rubbing contact between the bolt and housing. The cylindrical portion of the bushing fits around an extension of the elastomeric block which provides a resilient mounting and acts as a noise-suppressant.

The elastomeric block preferably also serves to bias the latch bolt towards said adjacent surface of the housing to provide resilient restraint against movement thereof in the direction of the axis of the first pivot pin. In addition, the elastomeric block desirably acts as a throw-out member and serves to restrict over-travel of the striker relative to the latch. It thus assists door opening upon release of the latch, this being particularly desirable when the door seals are inadequate.

Additional cushioning of the moving parts of the latch may be afforded by a further elastomeric block positioned in a recess in the plastics moulding and so disposed that, when the pawl is positioned to hold the bolt in its locking position, a pin on the pawl engages this further block. The bolt conveniently being spring-loaded and so arranged that, when the bolt is in its locking position, the pawl engages one arm of the bolt to prevent movement thereof whereas, when the bolt is in its fully open position, the pawl engages the other arm of the bolt and biases the bolt into a position in which said one arm engages an abutment. This abutment may be constituted by a projecting portion of the plastics moulding.

Figure 2:
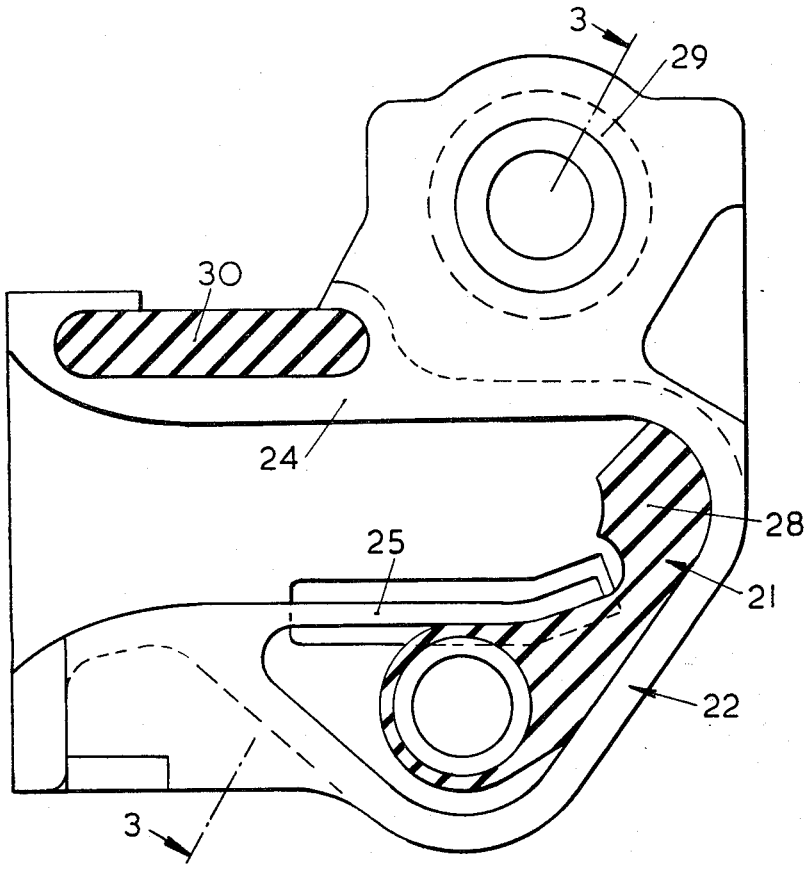
Figure 4:
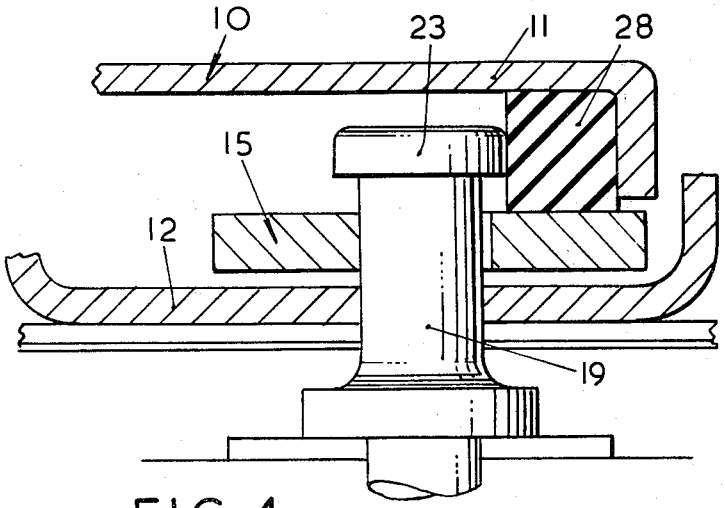

The invention will now be described by way of example with reference to the accompanying drawings which illustrate a motor vehicle door latch and in which:

FIG. 1 is a diagrammatic side view showing the bolt, pawl and keeper of a motor vehicle door latch, FIG. 2 is a side view of a plastics moulding containing elastomeric blocks and forming part of the door latch, FIG. 3 is a sectional view of the plastics moulding along the line 3—3 of FIG. 2, FIG. 4 is a horizontal sectional view of the latch showing the keeper in its "latched" position, and FIG. 5 is a detail sectional view showing the mounting of the latch bolt.

The latch includes a housing 10 which consists of two metal plates 11 and 12 which are fastened together by a pair of pivot pins 13 and 14 on one of which the latch bolt 15 is mounted and on the other of which the pawl 16 is mounted. The latch bolt 15 is of generally U-shaped and includes a pair of arms 17 and 18 between which the shank 19 of the striker is located when the door is locked in its closed position.

A plastics bushing 20 surrounds the pin 13 to prevent direct metal-to-metal engagement between the pin 13 and the bolt 15, the bushing 20 having a flange which is disposed on the side of the bolt 15 adjacent the front plate 12 of the housing so that the flange acts as a spacer to prevent frictional contact between the bolt 15 and front plate 12. The bushing 20 fits around an extension of a rubber block 21 which is located within the housing 10 by means of a plastics moulding 22. The rubber block 21 provides a resilient mounting for the bushing 20 and also acts on the bolt 15 to urge it towards the front plate 12 of the housing.

The plastics moulding 22 defines a guide channel for the enlarged head portion 23 of the striker 19 to ensure accurate alignment between the door and door frame during final closing movement of the door. This channel includes a continuous upper wall 24 and a leaf spring portion 25 providing part of the lower wall of the channel and arranged so that it is deflected by the head portion 23 of the striker during the final stages of closing movement. A wedging action is thus obtained ensuring positive door retention. The leaf spring portion 25 is supported by the rubber block 21 and fracture of said portion 25 as a result of repeated door opening and closing is thus avoided.

When the striker 19 is at the inner end of the guide channel and it is held between the two arms 17 and 18 of the bolt, rotation of the bolt 15 is prevented by engagement between a hook formation 26 of the pawl 16 and a cooperating formation 27 on arm 18 of the bolt, the pawl 16 being spring-loaded into its locating position by means of a spring. When the pawl is released and the bolt 15 is free to pivot into its release position, movement of the keeper 19 relative to the latch housing is assisted by a portion 28 of the block 21 which is held in a compressed state whilst the door is closed but which serves to provide an initial throwout action. The plastics moulding 22 also includes a portion 29 which surrounds the pivot pin 14 for the pawl 16.

In addition, the moulding 22 includes a seating for a rubber cushion 30 which is arranged to provide a resilient abutment for a pin 31 carried by the pawl 16, the pin 31 engaging the resilient abutment 30 when the pawl 16 moves into its locating position in which the hook formation 26 engages arm 18 of the bolt. The transmission of shocks between the pawl 16 and the moulding 22 is thus reduced with consequent reduction in the noise level upon door closure and in use of the vehicle.

What I claim is:

1. In a latch for the door of a motor vehicle comprising:

(A) a housing which includes front and back plates, (B) a generally U-shaped bolt arranged for engagement with a striker and mounted on a first pivot pin extending between the two plates, (C) a pawl arranged to co-operate with the bolt to hold it in its locking position, said pawl being mounted on a second pivot pin extending between the two plates, (D) a plastics moulding mounted between the two plates, the plastics moulding including guide portions which are arranged to co-operate with the striker to guide it into engagement with the bolt and to obtain a wedging action during the final stages of relative movement between the striker and the bolt, and (E) an elastomeric block disposed within the housing and including a first part arranged to act on the striker to provide a throw-out action and a second part which provides support for one of the guide portions of the plastics moulding, the improvement wherein the first pivot pin passes through an aperture in said elastomeric block such that the elastomeric block provides a sound damping mounting for the bolt.

2. A latch according to claim 1, wherein the aperture in the elastomeric block is in the said first part thereof and wherein the guide portion supported by said first part of the elastomeric block is in the form of a leaf spring.

3. In a latch for the door of a motor vehicle comprising:

(A) a housing which includes front and back plates, (B) a generally U-shaped bolt arranged for engagement with a striker, said bolt being mounted on a first pivot pin extending between the two plates, (C) a pawl arranged to co-operate with the bolt to hold it in its locking position, said pawl being mounted on a second pivot pin extending between the two plates (D) a plastics moulding located between the two plates, said moulding including upper and lower guide portions which are arranged to co-operate with the striker to guide it into engagement with the bolt and to obtain a wedging action during the final stages of relative movement between the striker and the bolt, and (E) an elastomeric block disposed within the housing and acting as a support for the lower guide portion of the plastics moulding, the improvement wherein the first pivot pin is disposed below the lower guide portion and passes through an opening in said elastomeric block such that the elastomeric block provides a sound damping mounting for the bolt.

4. A latch according to claim 3, wherein the second pivot pin is disposed above the upper guide portion, a second elastomeric block is located within a recess in the plastics moulding and a projection is provided on the pawl such that, when the pawl is positioned to hold the bolt in its locking position, this projection rests on and is supported by the second elastomeric block.

5. In a latch for the door of a motor vehicle comprising:

(A) a housing which includes front and back plates, (B) a generally U-shaped bolt arranged for engagement with a striker, said bolt being mounted on a first pivot pin extending between the two plates (C) a pawl arranged to co-operate with the bolt to hold it in its locking position, said pawl being mounted on a second pivot pin extending between the two plates, (D) a plastics moulding located between the two plates, said moulding including guide portions which are arranged to co-operate with the striker to guide it into engagement with the bolt and to obtain a wedging action during the final stages of relative movement between the striker and the bolt, and (E) an elastomeric block disposed within the housing and acting as a support for one of the guide portions of the plastics moulding, the improvement wherein the means for mounting the bolt on the first pivot pin comprises a flanged plastics bush which is fitted in an aperture in the bolt, the flange of the bush being disposed in engagement with an adjacent surface of the housing whereby it acts as a spacer to prevent rubbing contact between the bolt and the housing.

6. A latch according to claim 5, wherein the first pivot pin passes through an aperture in the elastomeric block and through the cylindrical portion of the plastics bush which fits around an extension of the elastomeric block.

7. A latch according to claim 6 wherein the elastomeric block acts resiliently on the bolt to bias the bolt in the direction of the axis of the first pivot pin towards said adjacent surface of the housing.

* * * * *